US009894990B1

(12) United States Patent
DuLac

(10) Patent No.: US 9,894,990 B1
(45) Date of Patent: Feb. 20, 2018

(54) SORTING, STORAGE, AND WORKSPACE UNIT FOR SMALL ITEMS

(71) Applicant: Don Glen DuLac, Rio Rancho, NM (US)

(72) Inventor: Don Glen DuLac, Rio Rancho, NM (US)

( * ) Notice: Subject to any disclaimer, the term of this patent is extended or adjusted under 35 U.S.C. 154(b) by 0 days.

(21) Appl. No.: 15/361,416

(22) Filed: Nov. 26, 2016

(51) Int. Cl.
*A47B 37/00* (2006.01)
*A47B 83/04* (2006.01)
*A47B 7/00* (2006.01)

(52) U.S. Cl.
CPC ..... *A47B 83/045* (2013.01); *A47B 7/00* (2013.01)

(58) Field of Classification Search
CPC ..... A47B 7/00; A47B 13/16; A47B 17/04; A47B 83/045; A47B 37/00; A47G 29/12095; A47G 29/12097
USPC ..... 312/194, 195, 211, 212, 60; 108/25; 232/30, 31, 32, 43.2; 446/482
See application file for complete search history.

(56) References Cited

U.S. PATENT DOCUMENTS 107,015 A * 9/1870 Dodge ..... A47B 77/16 312/212
557,095 A * 3/1896 Tate ..... B65F 1/06 222/130
849,622 A * 4/1907 Kent ..... G07F 9/06 211/50
888,294 A * 5/1908 Affleck ..... A47J 47/005 269/13
1,039,070 A * 9/1912 Baron ..... A47B 13/16 108/25
1,427,957 A * 9/1922 Hobart ..... A47B 17/04 312/194
2,268,637 A * 1/1942 Bernstein ..... B65D 5/48038 217/31
2,531,444 A * 11/1950 Lane ..... A47B 77/16 232/1 R
3,238,953 A * 3/1966 Barbie ..... G07D 9/002 209/703
5,221,010 A * 6/1993 Bianco ..... B07C 7/04 193/2 R
5,572,934 A * 11/1996 Aldridge ..... A47B 3/0912 108/24
2007/0056482 A1* 3/2007 Robinson ..... A47B 3/06 108/25

* cited by examiner

*Primary Examiner* — James O Hansen

(57) ABSTRACT

A sorting and storage unit includes a port panel with vertically arranged ports, wherein each port is horizontally offset from each of the adjacent ports. Bins, each having a top opening, fit into the ports of the port panel. Each bin is held within a port with at least a portion of the top opening of the bin horizontally offset from each bin in an adjacent port. A table top has a substantially flat upper surface and a lower surface. The table top is supported by the port panel. The table top includes apertures. Each aperture is aligned vertically above the offset portion of only one of the bins thereby creating a plurality of vertical, gravity-fed drop paths from the flat upper surface of the table top to the bins.

3 Claims, 7 Drawing Sheets

SORTING, STORAGE, AND WORKSPACE UNIT FOR SMALL ITEMS

DESCRIPTION OF THE PREFERRED EMBODIMENT

Figure 1:
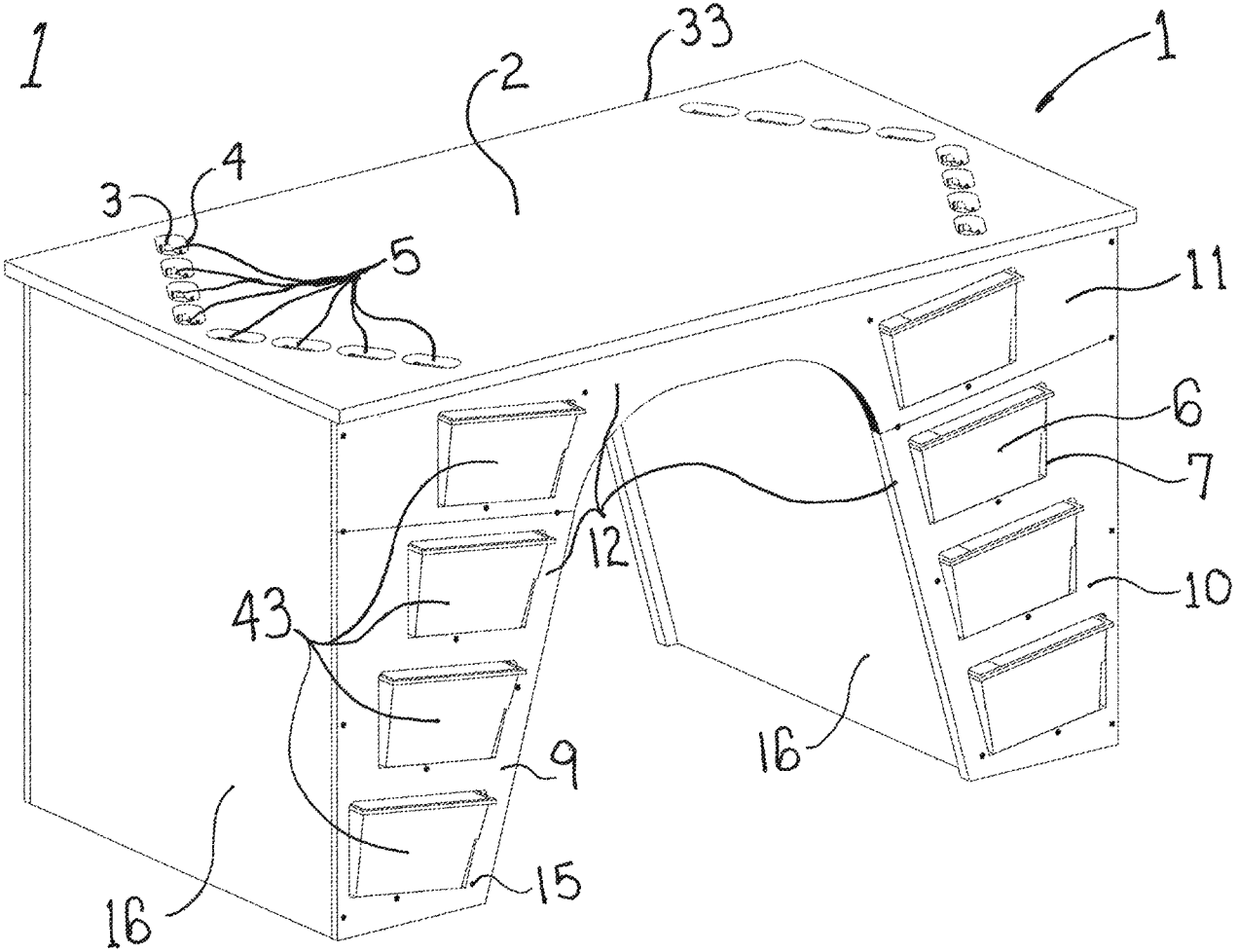
FIG. 1 is a perspective illustration of the inventive sorting and storage unit for small items.
Figure 2:
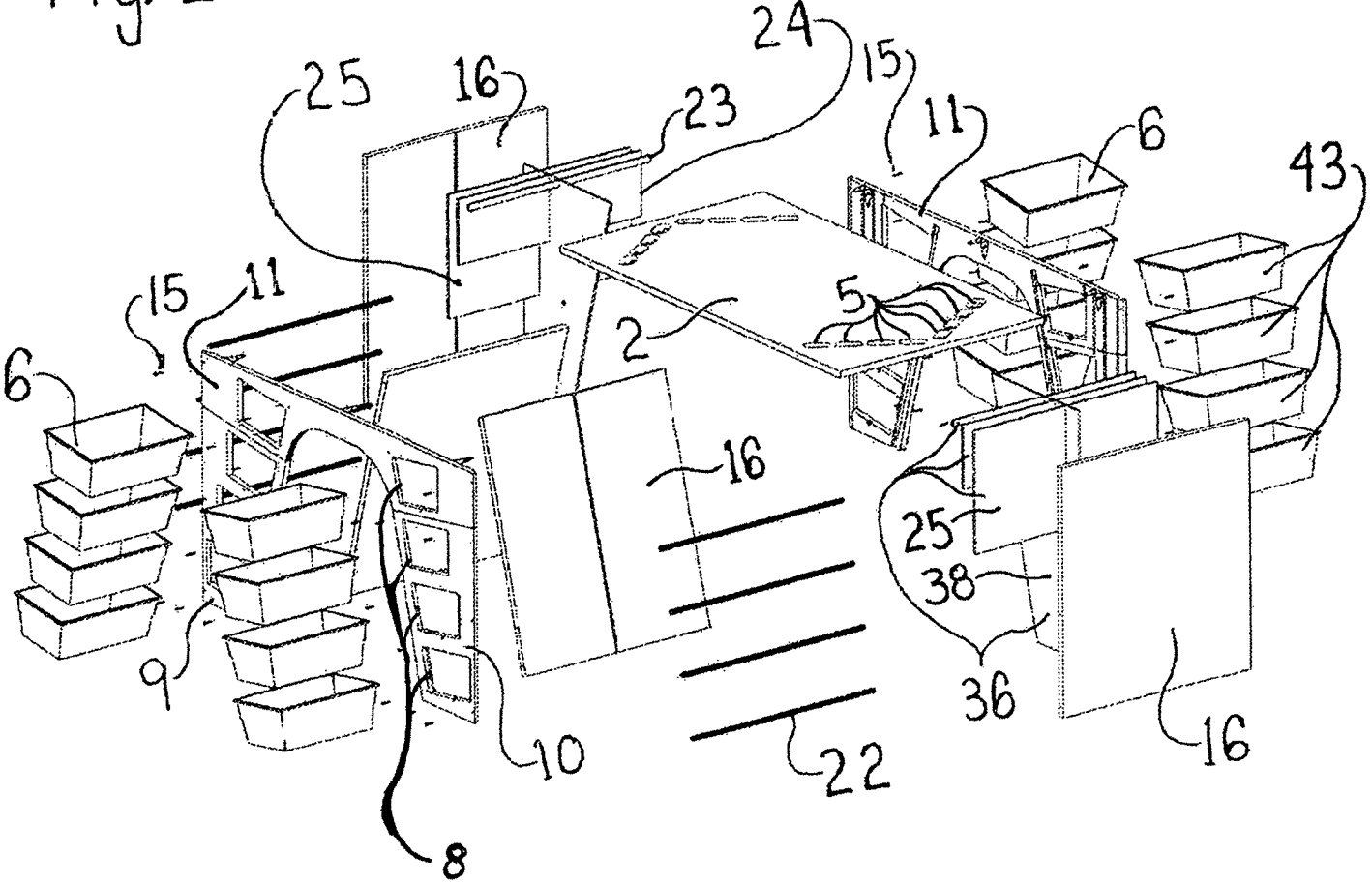
FIG. 2 is an exploded perspective illustration of the inventive sorting and storage unit for small items.
Figure 3:
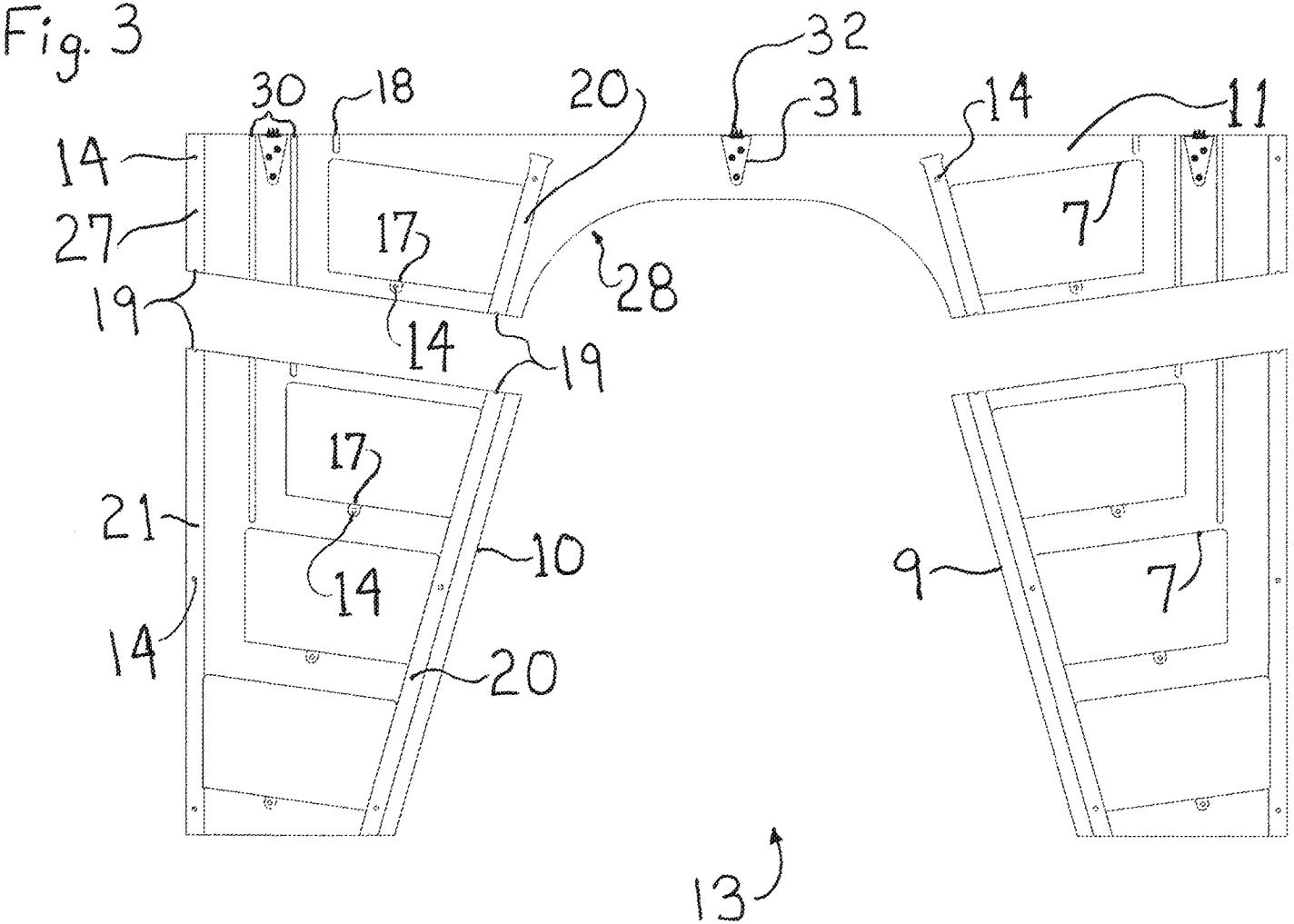
FIG. 3 is an elevation illustration detailing various dados, rebates, ports, and assembly holes.
Figure 4:
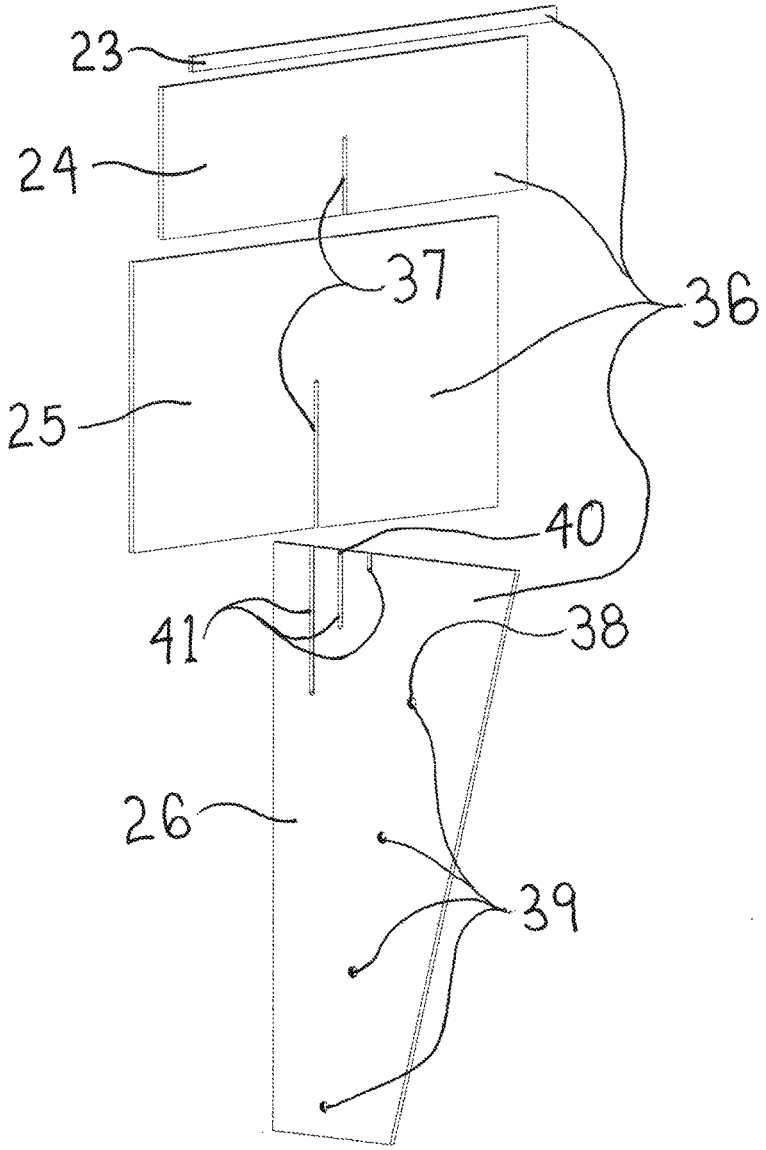
FIG. 4 is an exploded perspective illustration of the baffle group.
Figure 5:
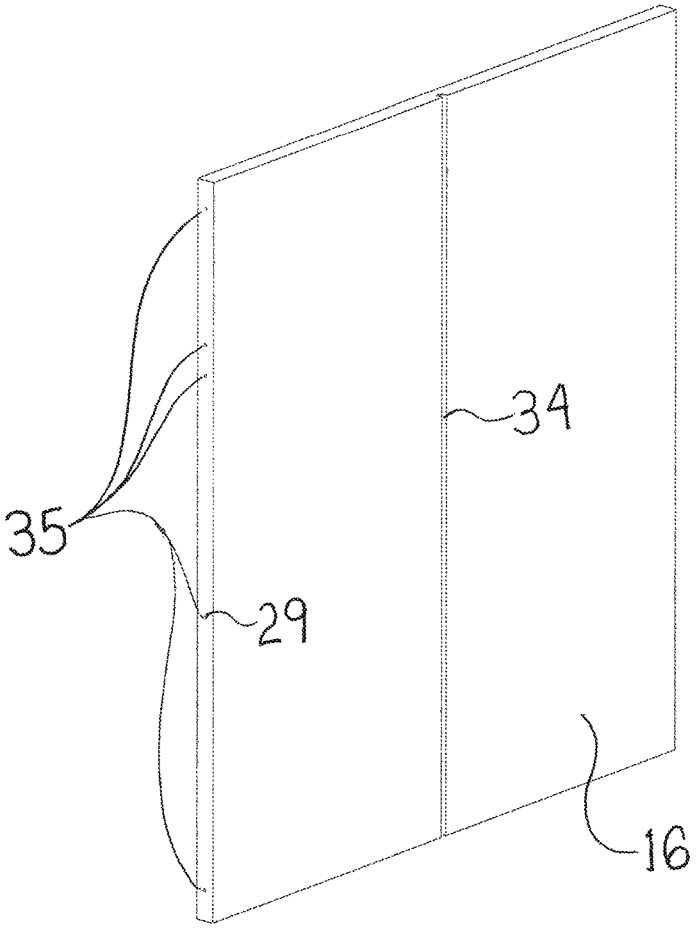
FIG. 5 is a perspective illustration of an exterior panel detailing the central dado and edge drillings.
Figure 6:
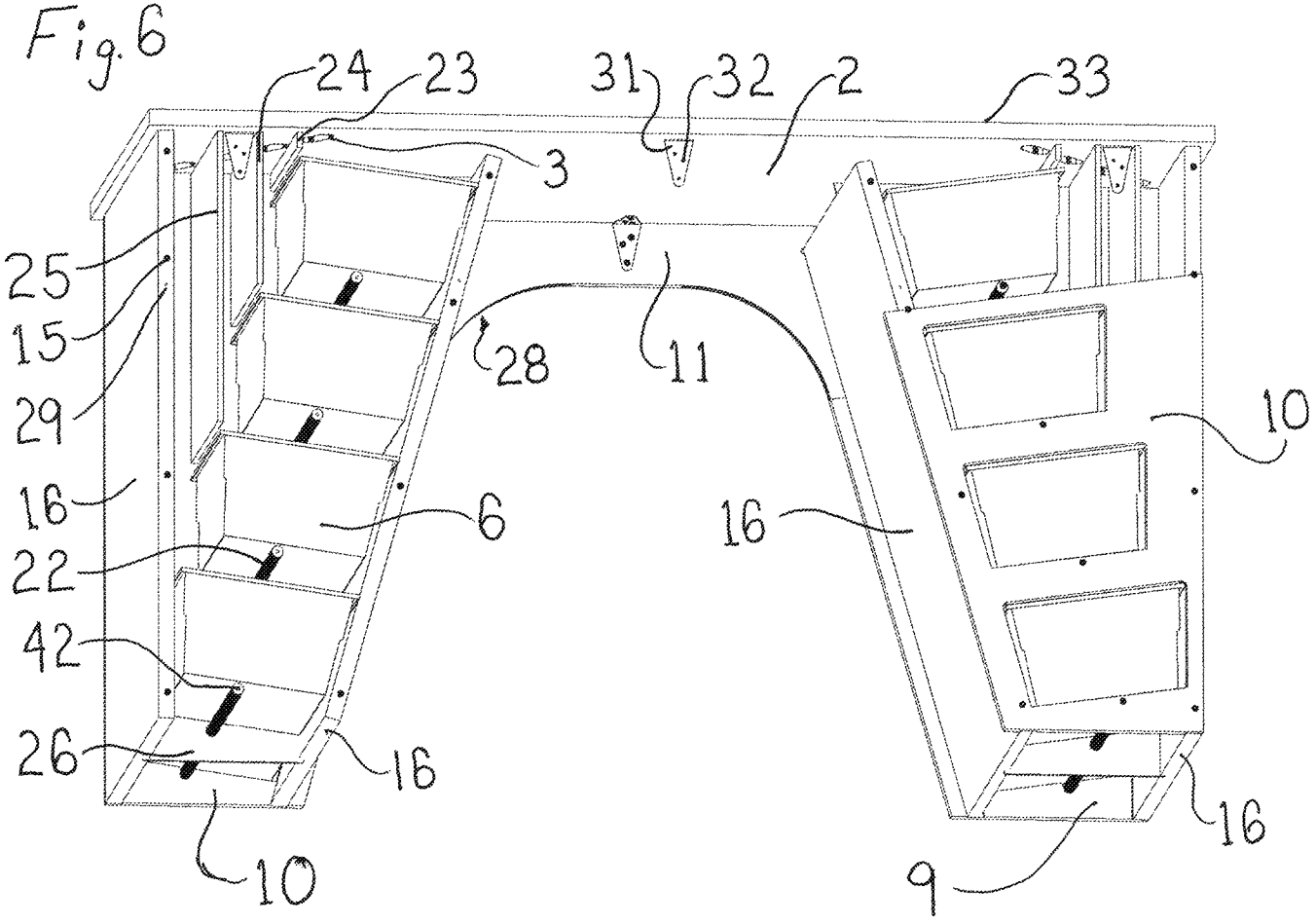
FIG. 6 is a partial perspective and interior illustration which shows the relationship between table top apertures, baffles, supporting dowels, and bins.
Figure 7:
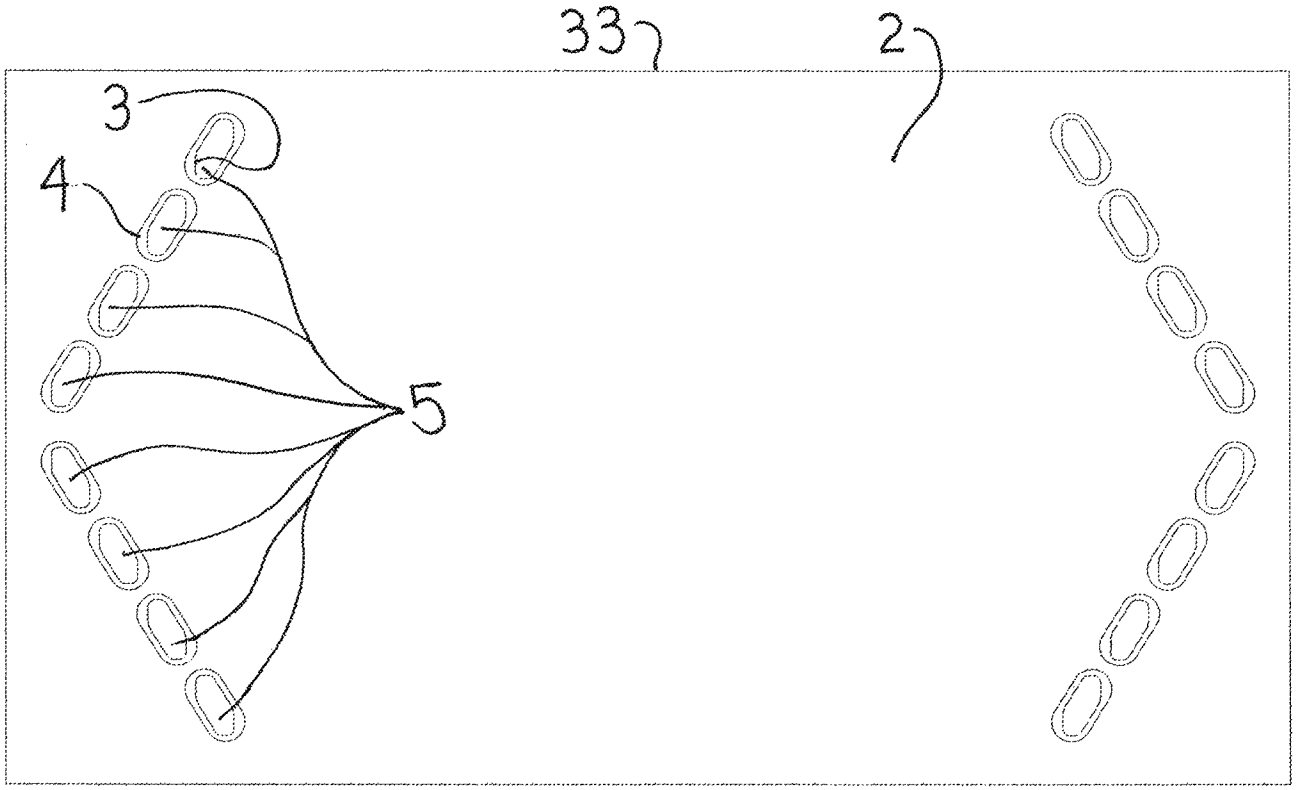
FIG. 7 is a plan view illustration detailing aperture shape, chamfer shape, and the table top with aperture matrix layout.

As shown in FIG. 1, the inventive sorting and storage unit for small items, generally designated by the numeral 1, variously formed from wood, includes the table top 2 with an aperture matrix 5 consisting of a plurality of apertures 3 with chamfers 4 arranged so that each aperture 3 vertically aligns over an interior vertically exposed portion of one of a plurality of offset bins 6 that are fully engaged into one of a plurality of ports 7 within the port matrix 8.

Ports 7 within port matrix 8 are isosceles trapezoid shaped. The longer of the two parallel sizes of said trapezoid is variably 105 percent of the widest width of bin 6 and serves as the uppermost portion of port 7. The shorter of the two parallel sides of said trapezoid serves as the lowermost portion of port 7. The angled edge of port 7 which is closest to the respective outside edge of the left lower port panel 9, right lower port panel 10, and upper port panel 11 is aligned vertically. The angled edge of port 7 which is closest to the respective inside edge of the left lower port panel 9, right lower port panel 10, and upper port panel 11 are in line with ports 7 within the port matrix 8.

Face 12 is comprised of upper port panel 11, right lower port panel 10, and left lower port panel 9 which form two port matrices 8 and chair passage 13. The height of face 11 is equal to the length of panel 16. The inventive sorting and storage unit for small items 1 has two outwardly opposing faces 11.

Left lower port panel 9 and right lower port panel 10 are mirrored versions of each-other. It will be understood that descriptions of right lower port panel 10 will also describe the mirrored left lower port panel 9.

Right lower port panel 10 incorporates all but the uppermost port 7 of port matrix 8. The uppermost edge of right lower port panel 10 serves as a linear joint which is parallel to the uppermost edge of port 7 and bisects the vertical distance between the lower edge of port 7 within upper port panel 11 and the uppermost edge of the uppermost port 7 within right lower port panel 10. The exterior facing portion of right lower port panel 10 exposes only the through-cut portions of port 7 and holes 14. The interior-facing portion of right lower port panel 10 incorporates rabbeted edge 21, wide dado 20, narrow dados 18, rebates 17, ports 7, holes 14, and half circular slots 19. The depths of each, not including the holes and half-circular slots, is variably 33 percent of the base material thickness of port panel 10. Width of rabbeted edge 21 and wide dado 20 is equal to the 110 percent of the thickness of the base material. Rabbeted edge 21 is parallel to the vertical edges of ports 7 and extends the full height of right lower port panel 10. Wide dado 20 is parallel to and adjoins the angled edges of ports 7 which is closest to the respective inside edge of the left lower port. Wide dado 20 extends for the full height of right lower port panel 10. Rebate 17 is located in the material that forms the lower portion of port 7, is located near the center of the bottom edge of port 7. The lower portion of rebate 17 is half-circle shaped with a diameter equal to the diameter of dowel 22. The upper portion of rebate 17 is a dado with a width equal to the diameter of dowel 22, perpendicular to the lower edge of port 7, and continues into the open area of port 7. The width of narrow dados 18 and continuous dados 30 is variably 110 percent of the base material thickness of medium baffle 24. Narrow dados 18 are parallel to the vertical edges of ports 7 and are horizontally inset from the vertical edge of each port 7, not including the lowermost port 7 of port matrix 8. Dado 18 terminates prior to encroaching into port 7, and each port 7 has one narrow dado 18 oriented in this manner except for the lowermost port 7 of port matrix 8. The diameter of holes 14 is variably 110 percent of the outermost diameter of the threaded portion of threaded fastener 15. Hole 14 is located in the center of the half-circle portion of rebate 17 and along the parallel centerlines of rabbeted edge 21 and wide dado 20 at intervals that allow horizontal alignment with drillings 29 in panel 16 when inventive sorting and storage unit for small items 1 is assembled. The uppermost edge of wide dado 20 and rabbeted edge 21 terminates with a half circular slot 19, is aligned with the respective holes 14, and is of the same diameter as hole 14.

Upper port panel 11 generally spans the length of the table top 2 and serves to stiffen the inventive sorting and storage unit for small items 1 in the assembled embodiment. In addition, upper port panel 11 incorporates two ports 7, each port 7 constitutes the uppermost port of the mirrored port matrices 8. The lowermost edges, exclusive of arcs 28, serve as a linear joint which is parallel to the lowermost edge of port 7 and bisects the vertical distance between the lower edge of port 7 within upper port panel 11 and the uppermost edge of the uppermost port 7 within right lower port panel 10 in the assembled embodiment. Port panel 11 is symmetrical with the uppermost ports 7 located within port panel 11 to serve as a continuation of the port shape, spacing, and angle necessary to maintain the mirrored port matrices 8 when combined in the assembled embodiment with left lower port panel 9 and right lower port panel 10. The exterior facing portion of upper port panel 11 exposes only the through-cut portions of ports 7, holes 14, and arcs 28. The interior-facing portion of upper port panel 11 incorporates rabbeted end 27, wide dado 20, narrow dados 18, rebates 17, ports 7, holes 14, and half circular slots 19. The depths of each, not including the holes and half-circular slots, is variably 33 percent of the base material thickness of upper port panel 11. Rabbeted end 27 is parallel to the vertical edges of ports 7 and extends the full height of upper port panel 11. Width of rabbeted end 27 and wide dado 20 is equal to the 110 percent of the thickness of the base material of panel 16. Rabbeted end 27 is parallel to the vertical edges of ports 7 and extends the full height of upper port panel 11. Wide dado 20 is parallel to and adjoins the angled edges of ports 7 which is closest to the respective arc 28 of the upper port panel 11. Wide dado 20 terminates below the upper edge of upper port panel. Rebate 17 is located in the material that forms the lower portion of port 7, and is aligned near the center of the bottom edge of port 7. The lower portion of rebate 17 is half-circle shaped with a diameter equal to the diameter of dowel 22. The upper portion of rebate 17 is a dado with a width equal to the diameter of dowel 22, perpendicular to the lower edge of port 7, and continues into the open area of port 7. Narrow dados 18 are parallel to the vertical edges of ports 7 and are horizontally inset from the vertical edge of each port 7. Dado 18 terminates prior to encroaching into port 7. Within upper port panel 11, continuous dado 30 serves as a continuation of dado 18 from right lower port panel 10 in the assembled embodiment. The diameter of holes 14 is 110 percent of the outermost diameter of the threaded portion of threaded fastener 15. Hole 14 is located in the center of the diameter of the half-circle portion of rebate 17 and along the parallel centerlines of rabbeted end 27 and wide dado 20 at intervals that allow horizontal alignment with drillings 29 in panel 16 when inventive sorting and storage unit for small items 1 is in the assembled embodiment. The lowermost edge of wide dado 20 and rabbeted end 27 terminates with a half circular slot 19, is aligned with the respective holes 14, and is of the same diameter as hole 14.

The interior un-machined portions and uppermost edge of upper port panel 11 is affixed to the underside of table top 2 with a plurality of metal hinges 31 and fasteners 32. In the assembled embodiment, two upper port panels 11 are oriented parallel to the long edge of table top 2, opposite each-other with uppermost edge flush with underside of table top 2, each forming a right angle in relation to the horizontal surface of table top 2, and with the horizontal distance between opposing machined faces of rabbeted ends 27 being equal to the width of panel 16. The uppermost corners of the upper port panels, when aligned in this manner, represent the four corners of a rectangle that is centered horizontally under table top 2. For shipping purposes, hinges 31 remain fastened to table top 2 and upper port panels 11 when the remainder of the inventive sorting and storage unit for small items 1 is completely unassembled. Hinges 31 allow for upper port panels 11 to be rotated from vertical to horizontal position to decrease shipping bulk and ease assembly by maintaining critical relational tolerances between upper port panels 11 and table top 2 that ensure proper functionality in the assembled embodiment without requiring alignment by end-users.

Table top 2 is rectangle-shaped with a length equal to twice the width of panel 16, a width equal to the length of panel 16, and is defined by a pair of aperture matrices 5, opposite each-other.

Aperture matrix 5 is transverse to and centered along the width of the base material of table top 2, and is comprised of a plurality of apertures 3 and chamfers 4. In the assembled embodiment, each aperture 3 is oriented vertically over the unobstructed portion of a respective bin 6 within port 7 as located within port matrix 8. Aperture 3 is a convex hexagon were each side is parallel to one other side of the same length. Within aperture matrix 8, the long side of each aperture 3 is in line with the long sides of all other apertures 3 that service the bins 6 with a respective port matrix 8. Aperture 3 extends vertically and completely through the base material of table top 2. Each aperture 3 begins at the lowermost portion of table top 2 and vertically transitions to chamfer 4 prior to extending completely through the uppermost portion of table top 2. The shape and orientation of chamfer 2 consists of two parallel sides that are also parallel to the longest parallel side of aperture 3 and spaced at a greater distance from each other than the spacing between the longest sides of aperture 3. The parallel lines of chamfer 4 terminate at semi-circles, each semi-circle with a radius matching the space between the parallel lines of chamfer 4. Chamfer 4 is centered over aperture 3. The uppermost outside edges of table top 2 embody chamfered edge 33. Chamfered edge 33 has a ¼" diameter.

Exclusive of the base material thickness dimension, panel 16 is rectangle-shaped and is defined by bisecting dado 34 and a plurality of drillings along the centerline of the long edge which comprise the drilling matrix 35. The interior-facing portion of panel 16 incorporates bisecting dado 34, which is parallel to the long edges of panel 16, and is centered horizontally between the long edges of panel 16. Bisecting dado 34 is variably 33 percent of the depth of the base material and has a width that is 110 percent greater than the thickness of center baffle 26 to allow for the edge of baffle 26 to loosely engage with bisecting dado 34 in the assembled embodiment. Each of the two long edges of panel 16 incorporates drilling matrix 29. The diameter of drilling 29 is 90 percent of the outermost diameter of the threaded portion of threaded fastener 15, and the depth is equal to the length of threaded fastener 15. The width of panel 16 is variably twice the length of the bottom of bin 6 as the width of panel 16 determines the depth of the port cavity interior to port 7, allowing bin 6 to fully engage below the respective portion of aperture matrix 5. The length of panel 16 determines the elevations of the underside of table top 2 and is variably 26 inches. The inventive sorting and storage unit for small items 1 is intended to allow for a seated adult to ergonomically reach each aperture 3 repeatedly as would be common when sorting amalgamated groups of small items. The manufactured length of panel 16, and the resulting elevation of table top 2, may vary to accommodate the ergonomics of users within a wide spectrum of sizes. The assembled embodiment of the inventive sorting and storage unit for small items 1 incorporates four panels 16 total. Two panels 16 form the left and right ends of the inventive sorting and storage unit for small items 1. Two opposing panels 16 form the angled walls of chair passage 13. In the assembled embodiment, one drilling 29 within drilling matrix 35 horizontally aligns with the opening formed when the outermost half circular slot 19 from upper port panel 11 adjoins the upper and outermost half circular slot 19 from right lower port panel 10. In the assembled embodiment, a separate drilling 29 within drilling matrix 35 horizontally aligns with the opening formed when the half circular slot 19, closest to chair passage 13, from upper port panel 11 adjoins the half circular slot 19, closest to chair passage 13, from right lower port panel 10. The remaining plurality of drillings 29 within drilling matrix 35 are spaced as structurally necessary. Holes 14 within face 12 horizontally align with drillings 29 in the assembled embodiment. It is important to note that two drillings 29 per panel 16 will not receive threaded fasteners 15 in the assembled embodiment, these non-utilized drillings facilitate the installation of a singular version of panel 16 in either the vertical orientation or the angled orientation per preference of the end user.

Baffle group 36 is comprised of short baffle 23, medium baffle 24, tall baffle 25, and center baffle 26. Base material thickness of each of the components of baffle group 36 is generally less than 50 percent of the thickness of table top 2 base material thickness. Exclusive of center baffle 26, the quantity of baffles within baffle group 36, transverse to table top 2, is generally one fewer than the quantity of ports 7 within port matrix 8. Exclusive of the base material thickness dimension, short baffle 23 is rectangle shaped, the length of short baffle 23 is equal to the width of panel 16 and the width generally equal to 95 percent of the vertical distance between the uppermost portion of the uppermost port 7 within port matrix 8 and the lowermost portion of table top 2. Exclusive of the base material thickness dimension, medium baffle 24 is rectangle shaped, the length of medium baffle 24 is equal to the width of panel 16 and the width generally equal to 95 percent of the vertical distance between the uppermost portion of the second-to-uppermost port 7 within port matrix 8 and the lowermost portion of table top 2. Medium baffle 24 is further defined by engagement groove 37, commencing at the center of medium baffle 24, and extending downward through the lower edge. The width of engagement groove 37 is equal to 110 percent of the thickness of base material of center baffle 26. Exclusive of the base material thickness dimension, tall baffle 25 is rectangle shaped, the length of tall baffle 25 is equal to the width of panel 16 and the width generally equal 95 percent of the vertical distance between the uppermost portion of the third-to-uppermost port 7 within port matrix 8 and the lowermost portion of table top 2. Tall baffle 25 is further defined by engagement groove 37, commencing at the center of tall baffle 25, and extending downward through the lower edge. The width of engagement groove 37 is equal to 110 percent of the thickness of base material of center baffle 26. Exclusive of the base material thickness dimension, center baffle 26 is trapezoid shaped, the uppermost and lowermost sides perpendicular to the outermost side, and the forth side at an angle from vertical equal to the angle from vertical of the port 7 edges of port matrix 8 closest to chair passage 13 in the assembled embodiment. The outermost side of center baffle 26 is equal in length to the length of panel 16. In the assembled embodiment, the two longer edges of center baffle 26 engage in the opposing bisecting dados 34 of two opposing panels 16, this orientation allows for center baffle 26 to bisect the area beneath aperture matrix 5. Center baffle 26 is further defined by bore matrix 39 and slot matrix 41. Bore matrix 39 is comprised of a plurality of bores 38. Bore 38 is circular and has a diameter equal to the diameter of dowel 22. Each bore 38 within bore matrix 39 is horizontally aligned between respective rebates 17 within left lower port panel 9, right lower port panel 10, and upper port panel 11. The quantity of bores 38 within bore matrix 39 is equal to the quantity of ports 7 within port matrix 8. Slot matrix 41 is comprised of a plurality of engagement slots 40. Engagement slots 40 align horizontally with narrow dados 18. The width of engagement slots 40 is equal to 110 percent of the thickness of the base material of center baffle 26 and the depth is equal to the thickness of center baffle 26. Engagement slot 40 commences at the uppermost edge of center baffle 26 and extends downward to a length equal to the length of the engagement groove 37 within the corresponding medium baffle 24 or tall baffle 25, and equal to the width of short baffle 23 for corresponding short baffle 23. Center baffle 26 is perpendicular to, and fully engages with short baffle 23, medium baffle 24, and tall baffle 25 in the assembled embodiment. In the assembled embodiment, the uppermost portions of baffle group 36 loosely abuts the underside of table top 2 with no portion of baffle group 36 visible through apertures 3 when viewed from directly above in a parallel projection manner. When engaged in the respective narrow dados 18, continuous dados 30, and bisecting dados 34, baffle group 36 is retained in position within the assembled embodiment without the use of fasteners.

Dowel 22 is cylinder shaped with a diameter that is variably 70 percent of the thickness of table top 2. The length of dowel 22 is equal to the width of panel 16. Dowel 22 is further defined by hollow 42, at each end of dowel 22. Hollow 42 is circular with a diameter equal to 95 percent of the outermost diameter of the threaded portion of threaded fastener 15, and a depth equal to the length of threaded fastener 15. In the assembled embodiment, one end of dowel 22 is fully seated in the lower portion of rebate 17. Dowel 22 extends horizontally from rebate 17, through the respective bore 38 of center baffle 26, and terminates in the respective opposing rebate 17. Dowel 22 is secured in place with threaded fastener 15, through the respective hole 14 within rebate 17, at each end.

Bin 6 is a commercially available, ne stable, plastic tray. When viewed from above, the upper edges of bin 6 generally form a rectangle, the greatest length of said rectangle is approximately 50 percent of the width of table top 2, and the width of said rectangle is approximately 60 percent of the length. The height of bin 6 is approximately 35 percent of the longest length. When viewed from above, the lower edges of bin 6 generally form a rectangle, and both dimensions of the lower rectangle are approximately 85 percent of the upper rectangle dimensions. The orientation of bin 6 within port 7 is affected by the angle from horizontal of the lowermost portion of port 7.

Description of the Use:

The inventive sorting and storage unit for small items 1 facilitates the process of sorting an amalgam of small items into a plurality of sorted groups wherein each small item shares one or more predetermined traits. A user commences the typical sorting process by ensuring that each port 7 houses a bin 6 in a fully-engaged position. Placing said amalgamated group of small items on the upper surface of table top 2, from a standing or seated position, individual items are identified and removed from said amalgamated group of small items. Each individual small item is then dropped through one of a plurality of apertures 3 within at least one ergonomically located aperture matrix 5 and falls into a corresponding bin 6 wherein one of said sorted groups is located. It is common for a label to be placed near each aperture 3 to identify the one or more shared predetermined traits associated with said small items within each small group.

The inventive sorting and storage unit for small items 1 functions as a repository for small items. Table top 2 can serve as a display area for assemblies of said small items. Bins 6, when fully engaged within respective ports 7, serve to contain groups of small items as well as to orient said groups of small items beneath table top 2, thusly providing partial protection to said groups of small items from environment conditions such as direct sunlight and dust.

The inventive sorting and storage unit for small items 1 facilitates the manipulation of a plurality of small items into assemblies by providing a workspace, comprising the ergonomically oriented horizontal surface of table top 2, and easily accessible bins 6. Small items stored within bin 6 may be accessed for said manipulation by sliding bin 6 horizontally outward from port 7 a distance up to about 75 percent of the length of bin 6, then released to allow gravity and the binding action between bin 6 and port 7 to suspend bin 6 and expose for retrieval of small items wherein. If desired, bin 6 may also be fully removed from port 7 for retrieval of said small items therein.

What is claimed is:

1. A sorting and storage desk for small items comprising:

at least one port panel including a port matrix comprising a plurality of vertically arranged ports, wherein each port is offset both horizontally and vertically from each of the adjacent ports within said port matrix;

a plurality of bins each having a top opening, wherein said bins are each sized and shaped to fit into said plurality of ports of said at least one port panel such that each said bin is held within one of said ports with at least a portion of said top opening of said bin offset both vertically and horizontally from each bin in an adjacent port within said port matrix; and a table top having a substantially flat upper surface and a lower surface, wherein said table top is supported by said at least one port panel and said table top is formed with an aperture matrix comprising a plurality of apertures, and wherein each of said apertures is aligned vertically above said offset portion of only one of said bins thereby directing small items to fall vertically via gravity from said flat upper surface of said table top to said bins whereby different small items fed through different apertures in said aperture matrix are sorted into different bins.

2. The sorting and storage desk of claim 1 further comprising at least one baffle fixed in a vertical position leading from each said aperture of said aperture matrix to said offset portion of said bin vertically disposed below each said aperture.

3. The sorting and storage desk of claim 1 further comprising at least one baffle fixed in a vertical position separating at least two apertures of said aperture matrix.

* * * * *